US006379237B1

(12) United States Patent
Gordon

(10) Patent No.: US 6,379,237 B1
(45) Date of Patent: Apr. 30, 2002

(54) ABRASIVE SPONGE GRIP

(76) Inventor: Winston Livingston Gordon, 28, Hathor Crs., Toronto, Ontario (CA), M9L 1C2

( * ) Notice: Subject to any disclaimer, the term of this patent is extended or adjusted under 35 U.S.C. 154(b) by 0 days.

(21) Appl. No.: 09/390,210

(22) Filed: Sep. 8, 1999

(51) Int. Cl.[7] ..... B24D 15/00
(52) U.S. Cl. ..... 451/523; 451/524; 451/525
(58) Field of Search ..... 451/523, 524, 451/525, 514; 15/244.1, 244.4

(56) References Cited

U.S. PATENT DOCUMENTS 3,771,190 A * 11/1973 Tischler et al. ..... 15/244 R
4,391,013 A * 7/1983 Janssen ..... 15/210 R
4,885,876 A * 12/1989 Henke ..... 51/393
5,429,678 A * 7/1995 Fany ..... 134/6
5,500,049 A * 3/1996 Kolinsky ..... 134/6
5,718,622 A * 2/1998 Jones ..... 451/524
6,044,513 A * 4/2000 Penn ..... 15/118

* cited by examiner

*Primary Examiner*—Timothy V. Eley
*Assistant Examiner*—Dung Van Nguyen
(74) *Attorney, Agent, or Firm*—Notaro & Michalos P.C.

(57) ABSTRACT

There is described a holder for releasably retaining an abrasive sponge or similar product comprising a base for holding the sponge therein, the base having a top surface and surfaces depending downwardly from top surface to border the sponge partially along at least three of its sides, and a handle releasably connected to the top surface of the base.

5 Claims, 3 Drawing Sheets

ABRASIVE SPONGE GRIP

FIELD OF THE INVENTION

The present invention relates to a holding device and more particularly to a holder for an abrasive sponge used for sanding or finishing various materials such as wood, metal and plaster.

BACKGROUND OF THE INVENTION

The traditional means of finishing surfaces, particularly wood surfaces, has been to use sandpaper. The sandpaper is oscillated back and forth on the surface being finished, pressure being applied by the fingers or palm of the user. Pressure applied in this way is inherently uneven however, resulting in untended irregularities in the finished surface and the inadvertent rounding of corners and edges. To avoid this, it is common to apply the sandpaper to a block of wood, rubber or metal for more even distribution of sanding pressure. Whether or not a sanding block is used, the sandpaper itself has a tendency to wear quickly, and it is constantly necessary to apply new sheets to the block. To obviate this problem, the sanding sponge has been developed which has a more durable, permanently attached, sanding surface.

Unlike sanding blocks, which are rigid and therefore readily adaptable to the attachment of handles or other grips, sanding sponges tend to be resiliently deformable, and are therefore not as amenable to the addition of handles or other holding means. The result therefore is that the user holds the sponge using his/her fingers, which can distort the sponge to cause uneven sanding, and exposing the fingertips and knuckles to injury due to impact, abrasion and rubbing. As well, because the sponge is adapted for hand use only, it's not useful for jobs beyond arm's length.

There is therefore a need for a device that is adapted to securely grip a sanding sponge and simultaneously provide a stable rigid or semi-rigid connection point for a handle, extension rod or other gripping means through which sanding pressure can be applied without the user having to physically hold the sponge.

SUMMARY OF THE INVENTION

The present invention provides a holder for an abrasive sponge that grips the sponge securely and which is adapted for connection to a handle or other gripping means, and which preferably allows for intermittent replacement of the sponge, and for the substitution of different kinds of handles or extensions.

It is therefore an object of the present invention to provide a holding device that obviates and mitigates from the disadvantages of the prior art.

It is a further object of the present invention to provide a holder adapted to permit the use of a handle or other grip in connection with an abrasive sponge.

It is a further object in a preferred embodiment of the present invention to provide a holding device which allows for easy replacement of the sponge.

It is yet another object in a preferred embodiment of the present invention to provide a holder that permits the sponge to be pushed into corners without interference from the holder itself.

According to the present invention then, there is provided a holder for releasably retaining an abrasive sponge or similar product, comprising a base member for holding the sponge therein, said base member having a top surface and surfaces depending downwardly from the edges thereof to border the sponge partially along at least three sides thereof; and a handle member releasably connected to said top surface.

BRIEF DESCRIPTION OF THE DRAWINGS

Preferred embodiments of the present invention will now be described in greater detail and will be better understood when read in conjunction with the following drawings in which.

DETAILED DESCRIPTION

Figure 1:
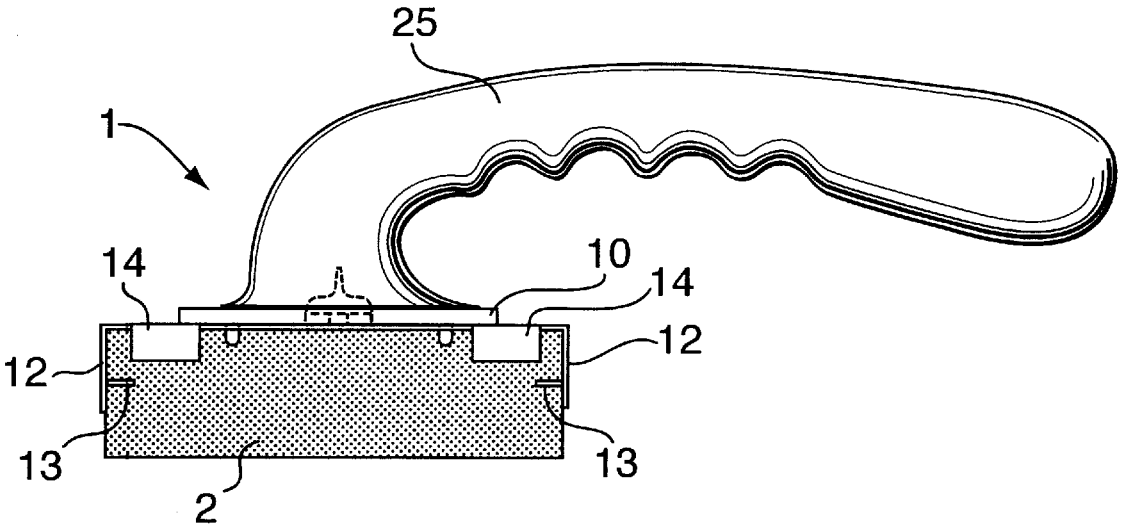
FIG. 1 is a side elevational view of the holder of the present invention configured with a handle grip.

Referring now to FIG. 1, an exemplary embodiment of the present holder 1 including a sanding sponge 2 is shown in an assembled condition. The holder generally comprises a base 10 adapted for interchangeable connection to a handle 25 or other gripping device as will be described below.

Figure 2:
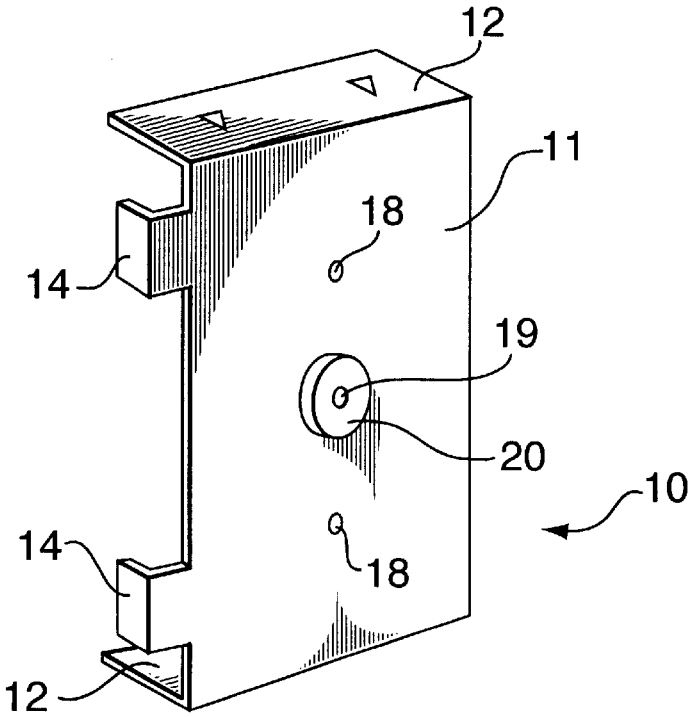
FIG. 2 is a perspective view of the base of the holder shown in FIG. 1.

With reference to FIG. 2, base 10 is generally channel-shaped having a top surface 11, two downwardly depending end surfaces 12 disposed at 90° to the top surface and two spaced apart 90° locator tabs 14 disposed along one edge of top surface 11.

Figure 3:
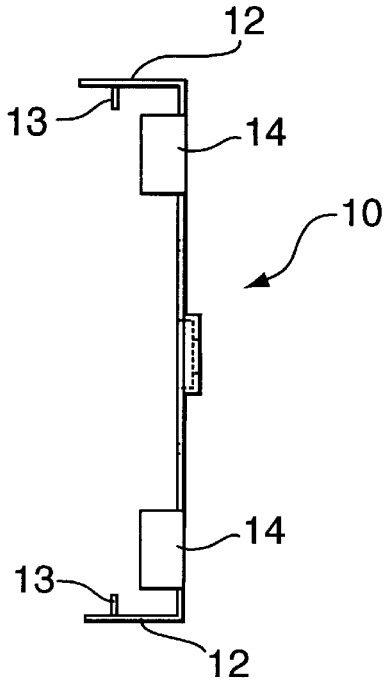
FIG. 3 is a side elevational view of the base shown in FIG. 2.
Figure 4:
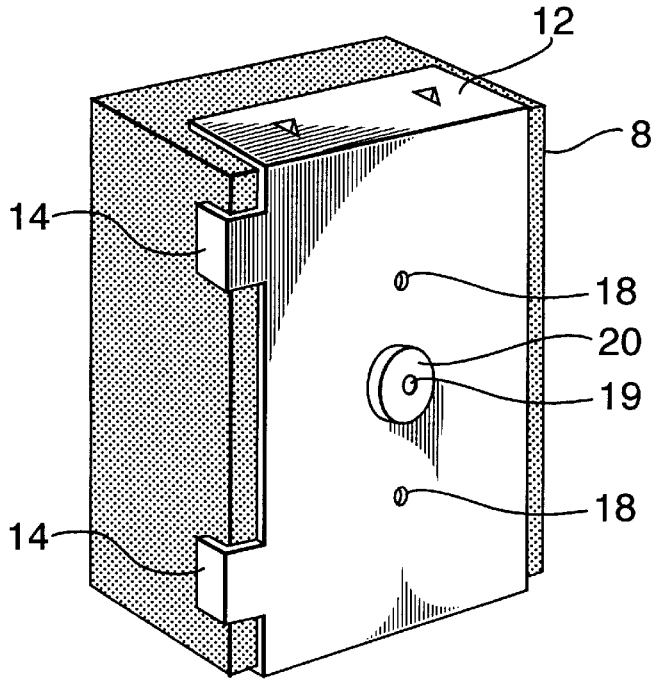
FIG. 4 is a perspective view of the base shown in FIG. 2 holding an abrasive sponge.

As seen most clearly from FIGS. 1 and 3, end surfaces 12 each include one or more inwardly directed and preferably pointed teeth 13 that penetrate the sponge to hold and retain it inside base 10. If the base is made of metal, the teeth can be punched from the material of the side surfaces or they can be welded in place. If the base is made of plastic, the teeth can be molded integrally with the side surfaces. Locator tabs 14 help position the sponge within the base and limit lateral side to side motion of the sponge during sanding operations. Although locator tabs can be used on both sides of the base, their use on one side only has some advantages. First, sponges of different length can be used without having to cut them to fit, and it allows the unconstrained edge of the sponge to be pushed flush into corners without damaging contiguous surfaces by contact with the tabs.

As will be seen from the drawings, the thickness of the sponge is preferably greater than the height of end surfaces 12 and locator tabs 14 so that the lower edges of these surfaces do not interfere with the surface being sanded. Preferably, the height of the end walls/tabs is about one half to two-thirds the thickness of the sponge. As well, the length of the sponge ideally will exceed the width of base 10 to expose at least a portion 8 of the sponge for sanding into corners and the like as mentioned above.

Figure 5:
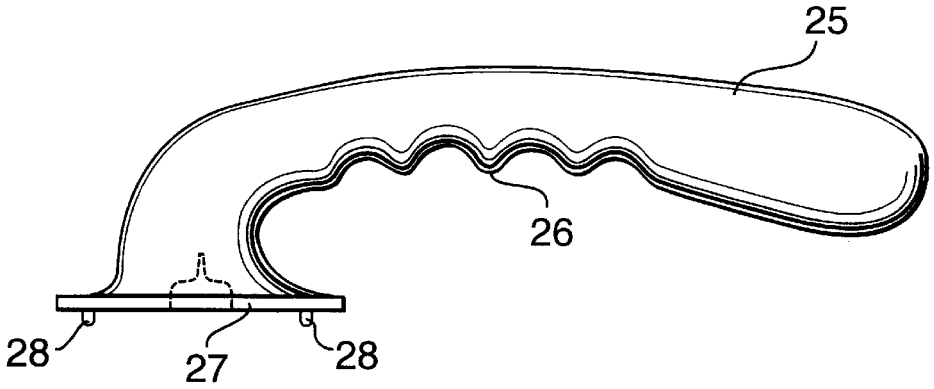
FIG. 5 is a side elevational view of a handle grip shown in isolation.

For sanding jobs at arm's length, base 10 can be fitted with a handle 25 of any suitable shape, an example of which is shown in FIGS. 1 and 5. Handle 25 includes a grip 26 and a flanged base 27 that fits against top surface 11 of base 10. To prevent the handle from rotating, flanged base 27 can include one or two pins 28 that fit into correspondingly sized and spaced holes 18 in top surface 11. A threaded fastener (not shown) can be driven into the handle from the underside of top surface 11 through a screw hole 19 to securely connect the handle to the base. The area 20 immediately around screw hole 19 can be punched or molded outwardly somewhat to provide some clearance for the screw head. Flanged base 27 of the handle should then be correspondingly recessed to receive the punched out portion but contact between the punched out portion and the recess in the base of the handle can take up some of the load from pins 28.

Figure 6:
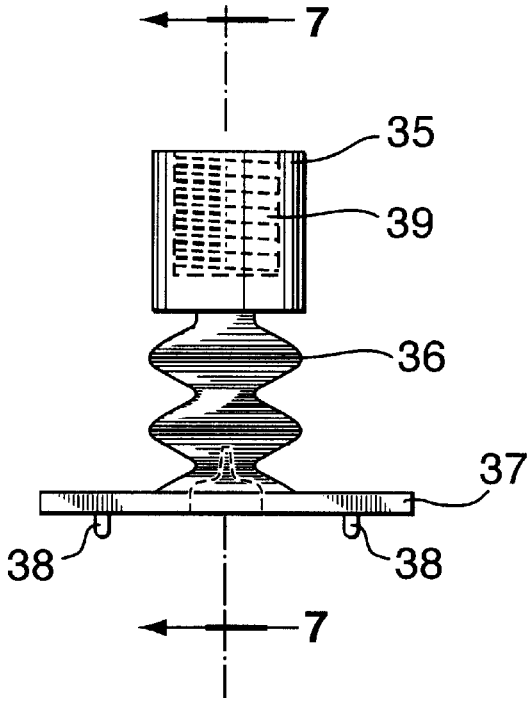
FIG. 6 is a side elevational view of a flexible necked adapter for connection to the base shown in FIG. 2.
Figure 7:
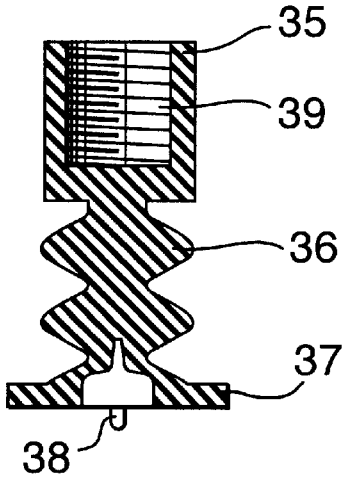
FIG. 7 is a cross-sectional end elevational view of the adapter of FIG. 6 along the line 7—7 in FIG. 6.

For more remote sanding jobs, handle 25 can be removed and placed by an adapter 35, an example of which is shown in FIGS. 6 and 7. The adapter, like the handle, includes a flanged base 37 including pins 38 that fit into holes 18 in the base's upper surface. If the adapter is made of a resiliently deformable material such as rubber or vinyl, it will preferably include a flexible neck 36. If the adapter is made of a non-resilient material, neck 36 can be replaced by a more conventional universal type joint. Above the neck is an internally threaded sleeve 39 that can be used to connect the holder to a correspondingly threaded rod or pole that can be used to move the holder to the remote location requiring sanding. Adapter 35 is connected to base 10 in the same manner described above with respect to handle 25.

In the alternative to the use of a threaded fastener to connect the handle/adapter to base 10, these components can be constructed to snap fit to one another, to slide together or even to be joined permanently such as by means of glue or forming the handle/adapter integrally with the base. Different means of connection will readily occur to those skilled in the art.

In use, the handle/adapter is connected to the base as described above, and the sponge is then installed. The width of the sponge ideally will be equal to or slightly greater than the distance between end surfaces 11 for a compressive fit. One edge of the sponge is pushed into the base against one end surface. The other edge is then compressed to clear the teeth on the opposite end surface and pushed into place. The opposite procedure is used to remove the sponge. If the handle/adapter is connected to the base by means of clips or sliders, the handle/adapter can be changed at any time without first removing the sponge. When the sponge is installed and retained by teeth 13, the handle can be used to apply sanding pressure through the sponge to the surface being finished.

If a sponge is not properly sized to fit within the base, it can be cut to fit. As well, the holder can be used to retain other kinds of semi-rigid products such as scouring pads and cleaning sponges.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

We claim:

1. A holder for releasably retaining an abrasive sponge comprising:

a base member for holding the sponge therein, said base member having a top surface and surfaces depending downwardly from the edges thereof to border the sponge partially along at least three sides thereof, said downwardly depending surfaces including a pair of opposed, spaced apart end surfaces extending downwardly from opposite ends of said top surface, said end surfaces including inwardly pointing projections thereon to penetrate the sponge and hold it in said base member;

a handle member releasably connected to said top surface;

said downwardly depending surfaces additionally including at least one tab member extending downwardly from at least one side of said top surface to abut an edge of the sponge to limit its lateral movement relative to said base member, the height of said end surfaces and said tab member being less than the thickness of the sponge;

wherein the width of said base member is less than the width of the sponge, whereby a portion of the sponge extends laterally beyond said base member.

2. The holder of claim 1, wherein said handle member includes at least one pin member extending therefrom to fit into a correspondingly sized hole in said top surface to prevent rotation of said handle member relative to said base member.

3. The holder of claim 2, wherein said handle member comprise an adaptor having a flexible neck portion and sleeve means thereon adapted for connection to an elongated member.

4. The holder of claim 3, wherein said adaptor member is releasably connected to said base member by means of a threaded fastener extending through said top surface into said handle.

5. The holder of claim 2, wherein said handle member is releasably connected to said base member by means of a threaded fastener extending through said top surface into said handle.

* * * * *